United States Patent [19]

Meyer et al.

[11] 4,057,148

[45] Nov. 8, 1977

[54] MULTIPLE SAMPLE SUPPORT ASSEMBLY AND APPARATUS FOR FACILITATING RADIOIMMUNOASSAYS AND THE LIKE

[75] Inventors: Rolf Meyer, Des Plaines; John E. Burgess, Arlington Heights, both of Ill.

[73] Assignee: G. D. Searle & Co., Skokie, Ill.

[21] Appl. No.: 596,760

[22] Filed: July 17, 1975

Related U.S. Application Data

[63] Continuation of Ser. No. 483,024, June 25, 1974, abandoned, which is a continuation-in-part of Ser. No. 292,738, Sept. 27, 1972, abandoned.

[51] Int. Cl.[2] ..... B01L 9/06

[52] U.S. Cl. ..... 211/74; 206/443; 233/26

[58] Field of Search ..... 211/74, 60 R; 248/56, 248/111, 314; 206/443; 233/26; 16/2

[56] References Cited

U.S. PATENT DOCUMENTS

| | | | |
|---|---|---|---|
| 3,161,906 | 12/1964 | Yarm | 16/2 |
| 3,175,695 | 3/1965 | Goodman et al. | 211/74 |
| 3,300,163 | 1/1967 | Randolph | 248/56 |
| 3,361,343 | 1/1968 | Lerner | 233/26 |
| 3,431,041 | 3/1969 | Fontilladosa | 211/60 R X |
| 3,551,062 | 12/1970 | Brown | 211/74 X |
| 3,643,812 | 2/1972 | Mander et al. | 211/74 |
| 3,664,617 | 5/1972 | Fenwick | 248/314 X |
| 3,709,429 | 1/1973 | McKenzie | 211/74 X |
| 3,768,115 | 10/1973 | Hoffmann | 248/56 X |

*Primary Examiner*—Roy D. Frazier
*Assistant Examiner*—Robert W. Gibson, Jr.
*Attorney, Agent, or Firm*—Walter C. Ramm; Albert Tockman; Dennis O. Kraft

[57] ABSTRACT

An improved multiple sample handling system, including a fully machine-compatible multiple sample support assembly, sample vortexing apparatus, and sample radioactivity sensing apparatus, is disclosed which enables performance of a complete radioimmunoassay or competitive binding procedure on the samples in the support assembly, generally without the need to remove and handle individual samples, and which greatly increases processing speed and error avoidance. The support assembly includes an apertured tray and sample retainers cooperating therewith and supporting the sample tubes by radially inwardly acting gripping portions. The retainers fit loosely within the tray apertures, but displacement control means are defined on the retainers and tray permitting the retainers together with tubes to smoothly move angularly relative to the tray within a small predetermined solid angle. The assembly with tubes is self-supporting upon the tubes for storage and optionally during sample operation. For mixing sample and reagents, the tubes are simultaneously vortexed in apparatus in which the tray is supported while a surface applying orbital forces contacts the lower tube portions. Mass centrifuging and decanting is readily performed by handling the tray assembly only. The radioactivity of one phase of each sample is sensed by a counting device in which the sample support assembly cooperates with a multiple counting chamber sensing head which accesses the samples from below to enable a plurality of samples to be counted simultaneously, without removing the samples from their support assembly.

8 Claims, 10 Drawing Figures

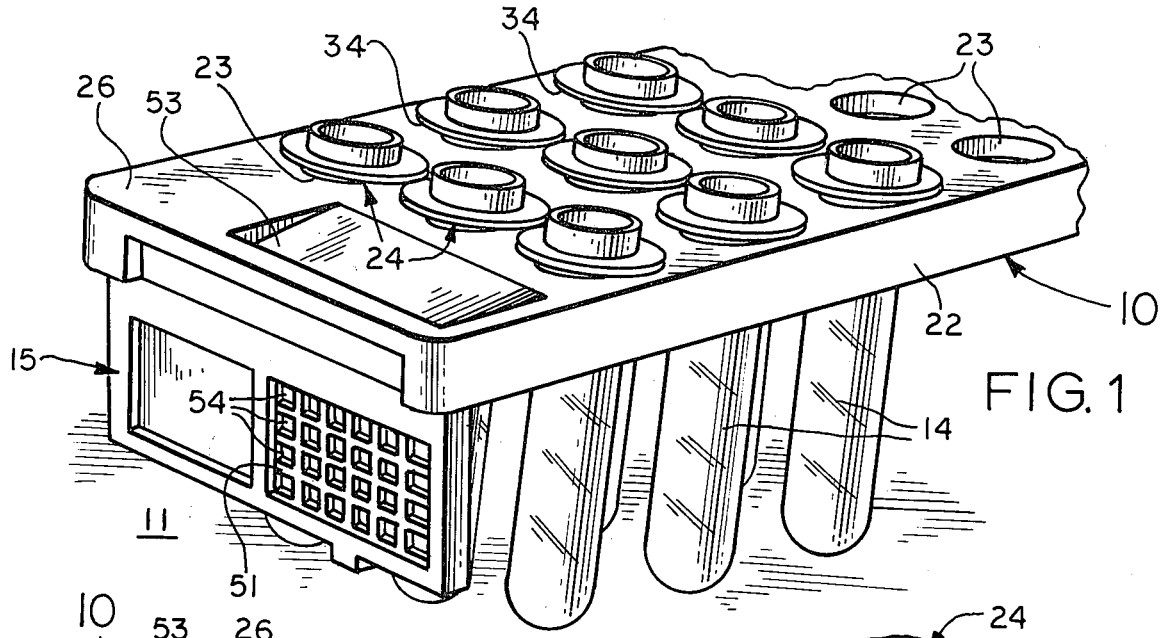
FIG. 1
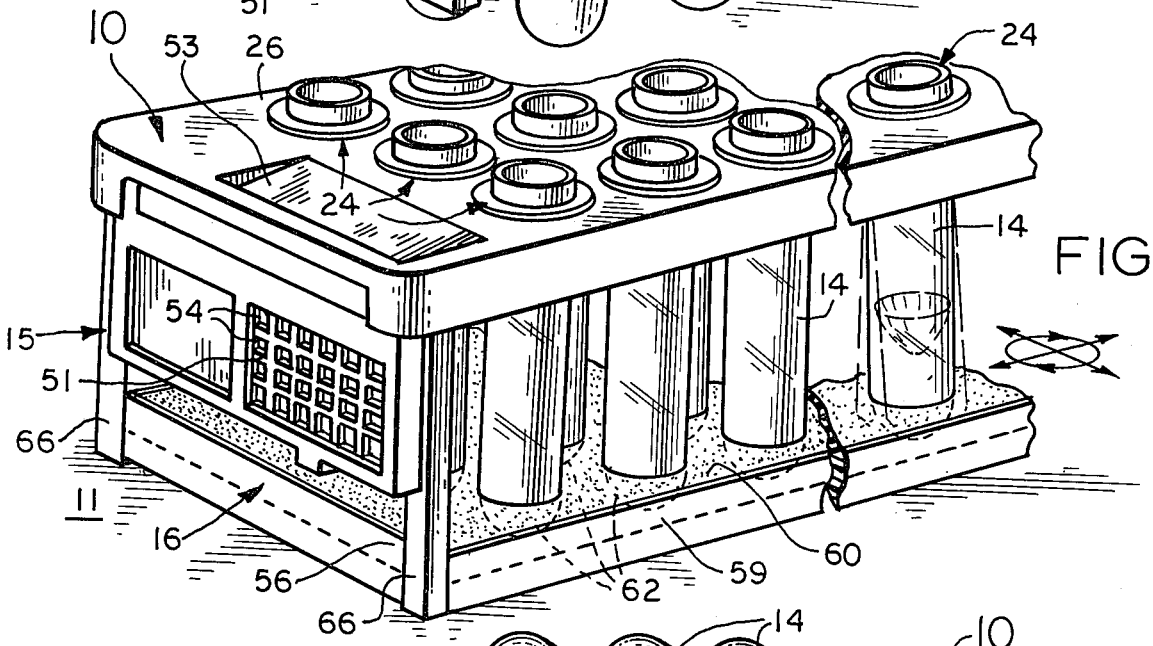
FIG. 2
FIG. 3
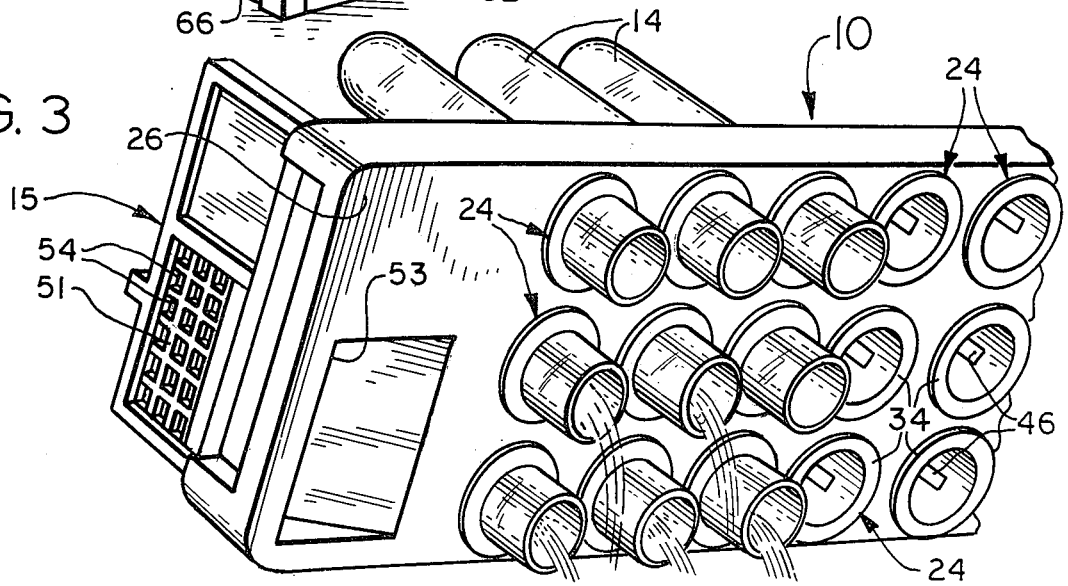

MULTIPLE SAMPLE SUPPORT ASSEMBLY AND APPARATUS FOR FACILITATING RADIOIMMUNOASSAYS AND THE LIKE

This is a continuation of application Ser. No. 483,024, filed June 25, 1974, and now abandoned, which is a continuation in part of application Ser. No. 292,738, filed Sept. 27, 1972, and now abandoned.

This invention relates to an improved multiple sample handling system for competitive binding assays, especially radioimmunoassays. In particular, the invention relates to an assembly for supporting a multiplicity of samples, and sample vortexing and radioactivity counting apparatus incorporating this support assembly.

BACKGROUND OF THE INVENTION

With the recent greatly accelerated growth in the procedures and applications involving competitive binding techniques, especially radioimmunoassay (hereinafter "RIA"), for medical diagnostic work and research, the need for greater processing volume and reliability, along with decreased labor and handling has become increasingly acute. In particular, the problem of avoiding the handling of individual samples has been a particularly difficult one to solve. The desire for greater automation, but in a manner which will decrease chances of error, expand technician capacity, and maximize the number of samples processed in a given amount of time is still a largely unfulfilled one.

As is well known, competitive binding techniques involve various steps to be performed with a multiplicity of samples, incuding the positioning of sample vials or tubes in an array, and labelling or otherwise identifying each, preparation of the samples, i.e. adding reagents and tracers, as well as diluting, replicating and the like, mixing, incubation, separation of the bound and unbound phases, and, in RIA, counting the radioactivity of each. Of course, this multiplicity of samples must be transported between the stations at which each of the above steps is to be performed, and some means of resting the samples between stations is necessary.

Much attention has been devoted to improvements of apparatus performing parts of the above procedure, but little attention or success has been given to improvements pertinent to the elements common to all of the foregoing steps. Accordingly, even improvements at one of the stations or steps have not been very valuable from the viewpoint of improving the entire procedure. For example, automated sample preparation equipment of various kinds has become available in recent years to shorten the work of the sample preparation step. However, the benefits of such equipment often are largely discounted, since typically extra effort must then be expended to identify the various tubes emerging from the equipment, as well as to thereafter individually load and unload tubes into mixing or vortexing equipment for many procedures, or other apparatus used in subsequent steps. Typically, the assembly which supports the sample during preparation, or some other subsequent step, is not compatible with one or more of the devices used in the other steps of the protocol. Furthermore, at some point in the procedure, separation between bound and unbound phases typically will be made, and this will usually involve decanting, another step which usually must be done on an individual sample basis.

Likewise, high throughput gamma counters have recently appeared with programmable operation, fast electronics and data processing equipment. But again, the efficiency advantages of such equipment are largely discounted, as is the case with improvements applicable to the earlier steps, because of the need to handle samples on an individual basis, or because of incompatibility with the preceding sample handling. Equally important, even without the foregoing problems, the counter typically cannot process more than one sample at a time, thus presenting an inherent efficiency bottleneck even without the foregoing problems.

More recently, with the invention of the apparatus disclosed in the commonly assigned co-pending application entitled, "Radioactivity Measuring Device with a Movable Detector Head", Ser. No. 366,676, filed June 27, 1973, as a continuation of application Ser. No. 273,768, filed July 21, 1973, a counter has been invented which would count more than one sample at a time. Known sample support or sample tray assemblies generally in use would certainly not be compatible with such apparatus. In particular, a sample support assembly has not heretofore been disclosed which is capable of cooperating properly with such an apparatus while enabling simplified processing without individual sample handling at earlier stages of the procedures. No improvement has yet to appear which would obviate the common drawbacks cited above, and enable a true improvement in the overall efficiency and simplicity of the entire process, particularly when simultaneously processing a multiplicity of samples.

SUMMARY OF THE INVENTION

It is an object of the present invention to provide a sample handling system apparatus to enable the simultaneous processing of a multiplicity of samples through all the competitive binding assay and RIA steps with considerably greater speed, efficiency and freedom from error than heretofore possible.

It is another object of the invention to provide a sample support assembly taking a multiplicity of tubes in an array and providing identification and a free standing capability for the tube array, and an adaptability to simultaneous mixing, centrifuging and radioactivity counting of a multiplicity of the samples, generally without removing samples from the support assembly.

It is also an object of the invention to provide a fully machine-compatible sample support assembly compatible with maximum and fastest-available machine processing at each stage of a competitive binding or RIA protocol.

It is yet another object of the invention to provide an aperture tray and retainers inserted therein for supporting sample tubes in an array while permitting both angular displacement of each tube and its retainer within a small predetermined solid angle and the retaining of each tube against longitudinal movement relative to the retainer, until propelled by an intentional resetting force.

It is a further object of the invention to provide an improved system for simultaneously vortexing a plurality of samples containing tubes without removal of such samples from a multiple sample supporting assembly.

It is a still further object of the invention to provide an improved system for manipulating and sensing the radioactivity of a plurality of sample containing tubes simultaneously, without the removal of individual samples from the sample support assembly.

In one broad aspect, the invention is an improved support assembly for handling and processing together a plurality of sample tubes and the like of a first cross-sectional size through the steps of competitive binding and radioimmunoassay protocols. This support assembly includes a tray normally horizontally disposed in use and defining a plurality of like vertically aligned apertures therethrough, each having a second cross-sectional size and of the same given depth, with this aperture cross-sectional size exceeding that of the tubes, and a plurality of generally annular retainers of deformable material for insertion into the apertures for holding said tubes generally upright with respect to the tray, each retainer defining an axial passageway therethrough of a third cross-section size somewhat larger than that of the tubes but less than that of the apertures.

Each retainer also includes an uppermost flange overlapping the upper surface of the tray, a body portion extending downwardly from the flange, with the body portion having a depth greater than that of the apertures and a cross-section smaller than that of the apertures for a loose fit therein, and a lower portion having an enlarged section with a cross-section smaller than that of the apertures for a loose fit therein, and a lower portion having an enlarged section with a cross-section slightly greater than the apertures. Each lower retainer portion defines a plurality of peripherally spaced elements extending generally in the axial direction, with these elements having gripping portions resiliently holding a tube therebetween against longitudinal movement relative to the retainer in the absence of an externally applied overcoming longitudinal force.

In this way, the tubes are held at preselected but immediately adjustable longitudinal positions relative to the tray, and the retainers and respective associated tubes are angularly displaceable from the perpendicular to the tray up to a limiting angle and thereupon immediately returnable to a vertical position by gravity. This enables the supporting of said assembly upon the plurality of sample tubes for storage, sample preparation, and sample incubation. Also, this enables the immediate adjustment of tube positions for decanting the plurality of tubes together, as well as the mixing or vortexing of the sample tube plurality together while still within the tray.

The aforementioned mixing or vortexing of all the sample tubes together while still within the support assembly is in a more detailed sense also the concern of another aspect of the invention, which is an improved apparatus for simultaneously mixing the components contained within each of a plurality of sample tubes or the like. The apparatus includes a tray defining a plurality of like vertically aligned apertures therethrough of cross-sections larger than the tubes and arranged in an ordered array, a plurality of generally annular retainers of deformable material for insertion into the apertures with a loose fit and each provided with an axial passageway therethrough for receiving a respective tube, with the passageway having a cross-section only slightly larger than the tubes, each retainer including a plurality of lowermost circumferentially spaced elements having gripping portions resiliently holding one of the tubes therebetween against longitudinal movement relative to the retainer in the absence of a sufficient externally applied overcoming force, displacement control means defined upon the tray and the retainers for holding the retainers together with the retained tubes within the apertures regardless of tray orientation and for at the same time enabling the retainers and associated tubes to be displaced freely within a predetermined solid angle from a position perpendicular to the tray through a range of positions in which the tubes and inserts are inclined with respect to the tray, and means associated with the tray support means for applying oscillatory forces generally in the horizontal plane to the retained tubes, with this means causing the tubes to undergo repeated controlled angular displacement from the vertical under the guidance of the displacement control means in synchronization with the oscillatory force. In this manner the contents of each of the plurality of tubes are efficiently mixed, yet the tubes are processed together as a unit and without requiring individual handling.

In still another aspect of this invention, an improved plural-sample manipulating and radioactivity sensing system is provided for use within apparatus for measuring the radioactivity of a multiplicity of discrete samples contained in sample tubes. This apparatus is of the type wherein the sample tubes are supported in an ordered lateral array, a movable radiation sensing device provides a plurality of signals simultaneously representative of the radioactivity of a plurality of samples, and transport means are provided for moving the sensing device beneath the sample tubes to access successive groups of the sample tubes.

The plural-sample manipulating and radioactivity sensing system itself includes a radiation detection head comprising said radiation sensing device and including a plurality of sample counting chambers opening upwardly into respective inlets, with the chambers and inlets having a cross-section larger than the sample tubes, each chamber being adapted to receive one of the tubes therewithin, and being spaced and inclined similarly relative to the adjacent chamber to define a first predetermined distance between chambers at the inlets, with the spacing increasing toward the lower ends of the chambers to define a first predetermined angle separating each of the chambers.

Also included in the system is at least one support assembly supporting the samples in the aforementioned ordered lateral array, with the assembly including a tray member normally horizontally oriented, and defining a plurality of like vertically aligned apertures therethrough arranged in the aforementioned ordered array with the array being arranged with groups of said apertures spatially related to the spacing between said chamber inlets, and with each aperture having a cross-section larger than said sample tubes, with the support assembly further including a plurality of generally annular retainers of deformable material for respective insertion into each aperture, and each provided with an axial passageway therethrough for receiving respective one of the tubes, with the passageway having a cross-section slightly larger than the tubes, each retainer including a plurality of lowermost peripheral spaced elements having gripping portions resiliently holding one of the tubes therebetween against longitudinal movement relative to the retainer in the absence of an externally applied overcoming longitudinal force, and means defined upon said tray and the retainers for holding the said retainers together with the retained tubes within the apertures and for at the same time enabling angular displacement of the retainers together with respective associated tubes through a range within a second predetermined angle from a position perpendicular to the tray, the first predetermined angle between the counting chambers being no greater than the second predetermined angle, while enabling immediate restoration of the retainers and respective associated tubes to the perpendicular position by gravity upon removal of the displacing force.

In this manner the said detection head with its plurality of counting chambers may be moved upwardly beneath the tray assembly by the transport means to angularly displace a first group of tubes into alignment with, and into engagement within, the counting chambers, to count the samples therewithin separately but simultaneously. Thereafter the detector head may be moved downwardly away from the first group, which thereupon resume their former orientation, and then to successive groups of tubes to process these in like manner.

BRIEF DESCRIPTION OF THE DRAWINGS

FIG. 1 is a perspective view, partially broken away, of the sample support assembly of the invention, with sample tubes retained therein, with the assembly being supported upon the tubes;

FIG. 2 is a perspective view, partially broken away, of a mixing or vortexing apparatus handling all the sample tubes at the same time while they are retained within the support assembly;

FIG. 3 is a perspective view, partially broken away, showing the support assembly being turned on one side and demonstrating the manner in which the sample tubes retained within the support assembly are decanted;

DETAILED DESCRIPTION

A general overall understanding of the multiple sample handling system of the invention may be obtained from taking FIGS. 1, 2, 3, and 4 together and considering the manner in which each illustrated unit or operation is related to the overall competitive binding or RIA procedure. The description will then be detailed with more particularity, and the remaining views will be considered.

Figure 7:
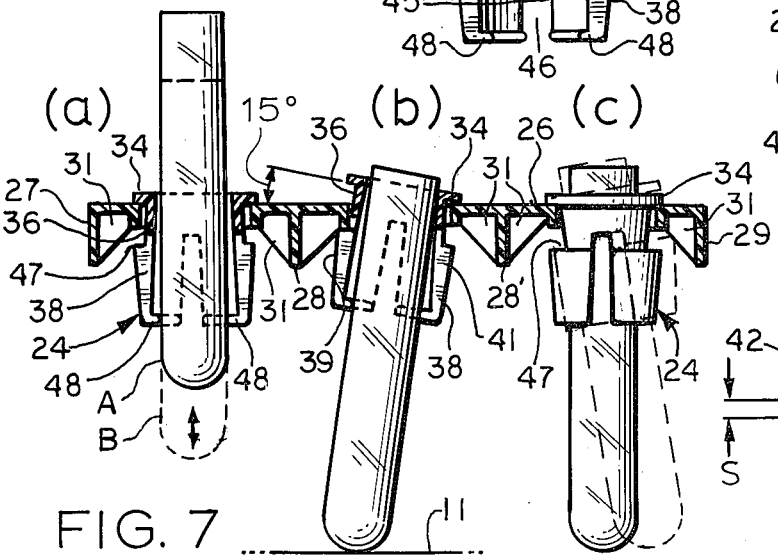
FIG. 7(a) is a view similar to FIG. 6(b) but with a sample tube inserted into the retainer, and the retainer in cross-section, showing how the tube may be longitudinally repositioned with this figure together with the related FIGS. 7(b) and 7(c) also showing the tray of the assembly in cross-section taken along a row.
FIG. 7(b) is a view similar to FIG. 7(a), showing how the tube may be angularly displaced, and the relationship between various elements when the support assembly is supported upon the tubes.
FIG. 7(c) is a view similar to FIG. 7(b) showing the manner in which the retainer and its associated tube move between the angularly displaced position, and a rest position.

In FIG. 1, a sample support assembly 10 is shown resting upon a flat surface 11, supported upon the retained conventional 12 millimeter sample tubes 14 themselves. (FIG. 7(b) shows a more detailed view of this and is described more fully below.) In this attitude, support assembly 10 together with test tubes 14 may be stored, ready for immediate use. When the technician is ready to perform a procedure, the assembly may be removed to a work surface or appropriate machine for sample preparation, including addition of various reagents, replication and dilution. For these purposes, the configuration and manner of use of support assembly 10 is similar to that of most conventional trays, and hence compatibility with conventional sample preparation methods, both manual and conventional, is maintained. At this stage, the support assembly may continue to be supported on the tubes, as in FIGS. 1 and 7(b), or it may be edge-supported in the conventional manner. An identification means 15 at one end of the assembly provides a quick tube identifying system, as well as compatibility with possible process control means for the mechanized operations on the samples.

In typical competitive binding and RIA protocols, one step which then may follow is that of mixing or vortexing, to insure that sample material and reagents or diluents are properly and uniformly combined. Heretofore done on an individual or group basis, in the system of the invention, it is done on a mass scale to all the tubes simultaneously and without removal from support assembly 10. As is illustrated in FIG. 2, the entire assembly is simply locked upon mixing apparatus 16 and then removed as a unit. Subsequent incubation is likewise easily managed by standing the support assembly in an appropriate location either upon the tubes as in FIG. 1 or upon an edge support. When the reactions are complete, the bound and free phases must typically be separated, for example by centrifugation. Again, conventional centrifugation apparatus is easily adaptable in obvious manner to take one or more entire sample support assemblies rather than individual tubes.

A common final step in the separation operation is the decanting of the liquid remaining after precipitation or centrifugation. Unlike known sample support assemblies, this step is easily effected in the invention by exerting a suitable force upon assembly 10 as the tubes rest upon a surface, to instantly raise the upper tube portions away from assembly 10 by a uniform distance, and then tilting assembly 10 on one side, as shown in FIG. 3. Cross contamination and spillage upon unwanted areas is practically eliminated, and tubes 14 remain retained in assembly 11 in the longitudinal relationship thereto which was determined by the technician. Although generally all the tubes are decanted in the foregoing manner without the need for individual handling, it may be necessary to remove temporarily a control tube in order to prevent compromising the control substance, for example, for total radioactivity.

Figure 4:
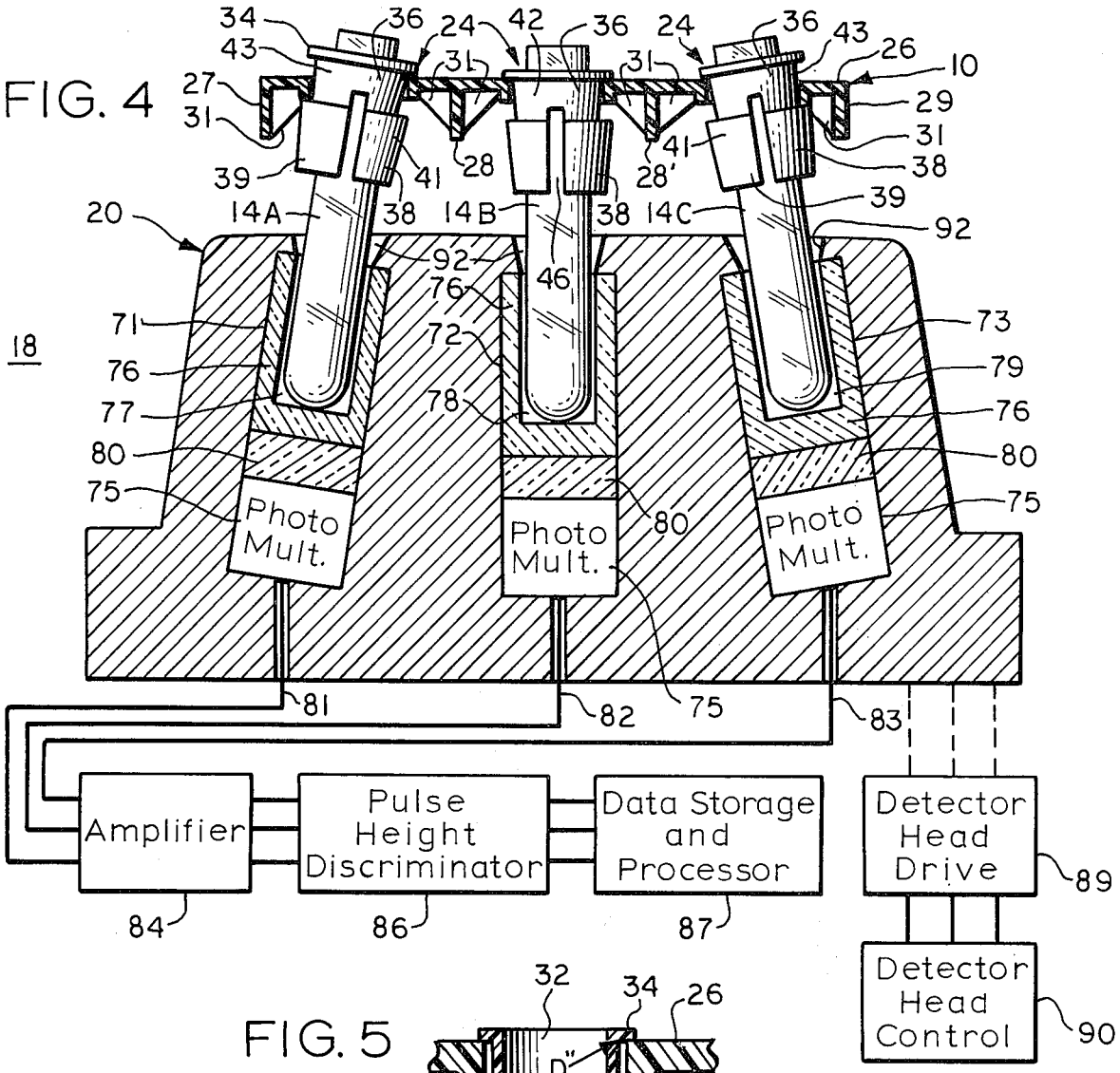
FIG. 4 is a partially schematic view of a scintillation counter showing the cooperation between a movable radiation detector head with upwardly opening multiple counting chambers, and the sample support assembly, shown in partial cross-section taken along a row thereof.

Finally, the level of radioactivity of one of the phases of each sample, usually that remaining after decanting, must be measured. As shown in FIG. 4, the entire support assembly 10 is simply supported upon an appropriate scintillation counting machine 18 equipped with the multiple counting chamber detector head 20, which in one operation simultaneously counts a plurality out of the multiplicity of sample tubes 14 carried in assembly 10 without removing any samples from assembly 10, thanks to the nature of the cooperation between assembly 10 and detector head 20, as is illustrated. Thus improved efficiency, great time savings, and marked lessening of the chances for error are demonstrated at every stage of the RIA or competitive binding protocol when done with the system of the present invention. Individual handling of samples is eliminated, except as may be necessary for the minimal number used for certain controls, as mentioned above, or for other unusual purposes.

Turning now to a more detailed consideration of the system, the most basic unit is sample support assembly 10. The assembly includes a generally rectangular tray 22, within which is defined an ordered array of apertures 23, a multiplicity of sample tube retainers 24 within apertures 23, and sample identification means 15, all of which accommodate the multiplicity of conventional tubes 14 in which the samples to be processed are placed. However, while such tubes are the most convenient in use, the system is not limited to such tubes, and other sizes could also be processed by providing suitably sized inserts therefor. Likewise, samples can also be placed in vials or other generally cylindrical containers instead of test tubes. Sample tubes 14 are accommodated by retainers 24 within apertures 23 in a manner to be described. The array preferably, but not necessarily, comprises three columns by twelve rows, and a two-column array is also a desirable variant. However, in order to illustrate assembly 10 to best advantage, it will be noted that only a few of the rows have been illustrated. Both the two and three-column variants are especially appropriate for RIA, as each row has two or more tubes which can accommodate replicates of the sampe sample, to monitor reliability. Also, since each sample is typically diluted two or three times, all dilutions of one sample can be accommodated on a single tray, each in a separate row.

Figure 6A:
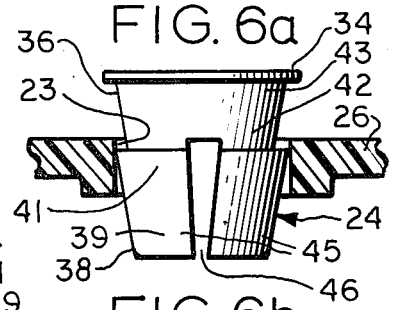
FIG. 6(a) is a detail view, similar to FIG. 5, showing the manner in which the retainer is inserted into the tray of the support assembly.
Figure 6B:
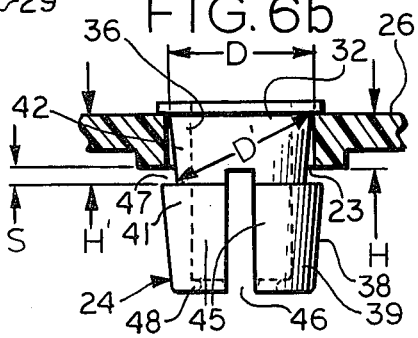
FIG. 6(b) is a detail view similar to FIG. 6(a) showing the details of the retainer within the tray of the support assembly.

Each tray aperture 23, as best seen in FIGS. 1 and 6(b), has a shallow cylindrical configuration with a circular cross-section, having a predetermined depth H, a uniform diameter D exceeding that of the tubes by a substantial fraction of the tube diameter, and vertical sides. All apertures 23 are identical, tray 22 itself is when in normal use disposed horizontally, and each aperture 23 is vertically aligned. The tray itself defines an upper planar surface 26 and side and central ribs 27, 28, 28' and 29 (see FIGS. 4 and 7(a)-(c)) extending perpendicularly downward from the tray sides and between the columns of apertures and running longitudinally from end to end. Also provided are triangular braces 31 extending upwardly from the ribs between the aperture rows for added rigidity. The tray need not be of any particular material, but glass reinforced polypropylene has been used and found to be desirable.

Figure 5:
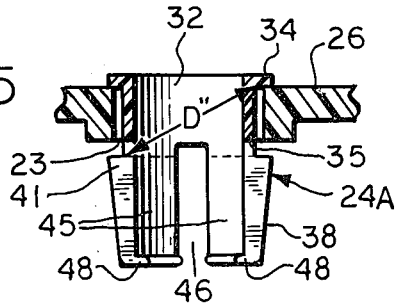
FIG. 5 is a detail view of the support assembly, partially in cross-section, showing a variant construction of the sample tube retainer of the support assembly.

The retainers 24 are shown in detail in FIGS. 5 (in which a variant form 24A is shown), 6(a), and 6(b), and in use in FIGS. 7(a), 7(b), and 7(c). They are designed for easy snap insertion into apertures 23, and for ready removal when desired, as well as for smoothly receiving and positively supporting tubes 14 in tray 22. Retainers 24 must be made of a flexible material having low "memory", that is, a material which will, when deformed, not remain in the deformed position, or acquire a predilection for the deformed position. One such material which has been used in the present embodiment is polypropylene. Retainers 24 are identical and of generally annular construction, each having a height greater than its largest diameter, a circular cross-section, and an axial cylindrical passageway 32 (FIGS. 5 and 6(b)) therethrough into which the test tube is passed. The passageway when retainer 24 is not associated with a tube has a diameter somewhat larger than that of tubes 14, and of course considerably smaller than that of tray apertures 23.

As between the two variant retainer forms, 24A and 24, the latter construction is preferred. However, in either case, the retainer will include an uppermost flange 34 extending outwardly and of large enough diameter to overlap one of apertures 23 upon insertion therein, a body portion 35 for retainer 24A in FIG. 5, and 36 for retainer 24 in FIGS. 6(a) and 6(b) and 7(a-)-(c), extending downwardly from flange 34, and is the portion actually within tray aperture 23 in use. Body portion 35 or 36 is everywhere of reduced diameter compared to the apertures 23 for a loose fit therewithin. The retainer further includes a lower portion 38 which tapers upwardly from a lower reduced diameter section 39 to an upper enlarged section 41. Body portion 36 is preferred (see especially FIG. 6(a) and tapers radially outwardly from a reduced diameter lower lever 42 immediately above enlarged section 41 to an upper level 43 just below flange 34, the level 43 diameter being slightly less than that of aperture 23. The alternative body portion 35 can be cylindrical in configuration, with a uniform reduced diameter less than that of aperture 23.

Since both retainer variants 24 and 24A generally operate and relate to tubes 14 and apertures 23 similarly, the details of the retainer 24 with the tapered body portion 36 will now be described at various stages of its use, and serve also to describe the details and use for retainers 24A of FIG. 5. Of course, the two retainer variants described herein are suggestive of other possible designs employing the same features. From FIG. 6(a), showing the insertion of retainers 24 into apertures 23, and 6(b), showing the retainer after insertion, the details and purpose of lower portion 38 of the insert may best be appreciated. Lower reduced diameter section 39 is smaller in diameter than that of aperture 23, while the diameter of enlarged section 41 is slightly larger. Lower portion 38 is divided into four circumferentially spaced elements 45, of arcuate cross-section extending generally axially downward, by four longitudinal slots 46 spaced 90° apart. Slots 46 preferably extend upwardly partially into body portion 36. The aforementioned taper of portion 38 may be varied, or may terminate below the enlarged section 41, but in any event, lower section 39 of lower portion 38 should be of reduced diameter to facilitate insertion into the tray apertures.

Slots 46 help to enable elements 45 to be smoothly compressed radially inward as the retainer is pushed into the aperture, and thereby reduce the diameter of enlarged section 41 enough to allow it to pass into and through an aperture 23 as shown in FIG. 6(a) into the position of FIG. 6(b) with a snap action. Once retainer 24 is in position, it is held within tray 22 by flange 34 and enlarged section 41, or more properly the annular indent 47 defined by enlarged section 41 and the reduced diameter lower level 42 of body portion 35 or 36. However, the retainer may be easily removed from tray 22 by simply grasping elements 45 and radially compressing them to reduce the diameter of enlarged section 41 sufficiently to pass upwardly through the aperture.

FIG. 7(a) shows the manner in which a test tube is received into the installed retainer into working position in the tray. It will be noted that the lowermost extremities of elements 45 are each equipped with lips or gripping portions 48. The gripping portions protrude radially inwardly and define a spacing therebetween which is less than the diameter of sample tubes 14. Thus, upon insertion of a sample tube 14 into an installed retainer 24, the tube forces elements 45 apart somewhat. Elements 45 in turn exert an inwardly acting radial force to positively hold the tube in any longitudinal position relative to tray 22 or retainer 24 to which it is preset. This resilient radial force is sufficient to ensure that the tube will not move longitudinally under its own weight or that of the sample. Indeed, sample support assembly 10 is self-supporting upon the tubes 14 because of the resilient force. However, gripping portions 48 are smoothly rounded and this, together with the smoothness of the tubes, and the limited magnitude of the resilient force, permits the tubes to be easily repositioned upwardly or downwardly when desired either individually or simultaneously together. To remove tubes 14 upwardly, for example, from position A (solid lines) to position B (in phantom) in FIG. 7(a), either upward force on the bottoms of the tubes 14, or downward force on the top of the tray 22, is applied.

It should also be noted that with the insertion of a tube, enlarged section 41 is expanded even more, as can be seen in FIG. 7(a), so that the retainer and tube are locked into the aperture even more positively, regardless of assembly orientation. Thus, as shown in FIG. 3, up-ending or turning support assembly 10 on its side to decant presents no problem; retention of tubes 14 is positively maintained, while the degree of projection of the tubes from the upper tray surface 26 is immediately adjustable to the most convenient height for best pouring and minimum spillage. Because slots 46 do not extend upwardly into the part of body portion 36 within the aperture, the separation of elements 45 forced by the sample tube insertion does not affect the fit or relationship between body portion 36 and aperture 23, and the bending is confined to the lower level 42 of body portion 36, as well as lower portion 38.

FIGS. 7(b) and (c) show the manner in which retainers 24 together with associated sample tubes 14 may undergo controlled smooth angular displacement and retain the same preselected longitudinal positions. In order to accomplish this, both body portion versions 35 and 36 are carefully spatially related to the configuration of cylindrical tray aperture 23. The distance represented by a diagonal D′ (or D″, see FIGS. 6(b) and 5) extending from a point on the periphery at lower level 42 of body portion 36 (or 35) to a point on the periphery at upper body lever 43 should be no larger than tray aperture diameter D, and preferably somewhat less. This aids in facilitating and controlling the angular displacement of retainers 24 or 24A, and associated tubes. Even more important for the control of angular displacement is the relationship between the aperture depth H and the distance between flange 34 and enlarged section 41 or indent 47, i.e. the height H′ of body portion 36 (or 35). Indent 47 (or enlarged section 41) must be spaced from the lowest portion of the aperture 23, and the height H′ of body portion 36 defines the extent to which indent 47 will be spaced below the lowest edge of aperture. Because of this spacing (shown in FIG. 6(b) as S) and because the diameter of body portion 35 or 36 is reduced as compared to aperture 23, the retainer 24 (or 24A) together with associated tube is angularly displaceable from the vertical (or from the perpendicular to the tray); see FIGS. 7(b) and 7(c). In the embodiment shown, spacing S and diagonal D is fixed so that the angular displacement of the retainer, together with associated tubes, is limited to 15°, for optimum compatibility with detector head 20 (see FIG. 4).

In actuality, retainers 24 (or 24A) and associated tubes 14 are rotatable through, as well as displaceable through, a range of angles within a solid angle centered about the original longitudinal axis of the tube and retainer, up to a limit of 15° from that axis. As will be seen, these capabilities are especially useful for mixing or vortexing. For vortexing action, the tube and retainer is displaced to one side, then rotated in an orbital pattern, as discussed below. For such a rotational displacement, retainer 24 with tapered body portion 36 may be preferable, since it mates especially smoothly with the cylindrical wall of aperture 23 in such operation, as may be seen in FIGS. 7(b) and 7(c). In either case, however, we have described means defining a loose but controlled fit between aperture and retainer which is especially adapted to smooth and effective angular displacement control and maintenance within preset limits, and which permits gravity to immediately restore the retainers and tubes to a vertical position without any possibility of binding upon removal of a displacing force.

The aforementioned identification means 15 for support assembly 10 includes an identification card holder 51 extending downward from and perpendicular to the surface 26, including a slot 53 through tray 22 into which a coded plastic tray identification card can be inserted to be retained within the holder. Holder 51 has an array of rectangular openings 54. If a plastic identification card has corresponding removable sections, several of these sections can be removed from the card so that the card, and the support assembly, is uniquely coded. Light beams shining on each of the openings 54 will then pass only through those openings which are associated with portions of the identification card from which sections have been removed. An optical detector positioned on the other side of the holder will then detect a unique pattern of light beams, which pattern can be translated into an identification number, or into signals for process control of apparatus into which the support assembly is placed for performing various steps of the protocols.

The combination of features of support assembly 10 which have now been set forth, in particular the smooth controlled angular displacement means, in cooperation with the feature by which the tubes may be retained at any preselected longitudinal position, is extremely important. It is this combination of features in the physically very simple and reliable support assembly which makes possible the present sample handling system in which no individual tube generally ever needs to be removed from the support assembly throughout all the steps of the protocol, and in which machine compatibility is at a maximum. It will also be noted how many of the elements of the retainer in particular contribute to more than one useful feature. For example, lower portion 38 and enlarged section 41 are related to the aperture to enable snap-in installation; also, these portions expand upon installation of the tube to positively lock the retainer and tube within the support assembly, thereby permitting the assembly to be stood on the tubes safely on any available level surface.

More specifically, with the present sample support assembly, the highly advantageous mixing or vortexing apparatus 16 of FIG. 2 is made possible. A generally rectangular frame 56 is provided which rests upon a supporting surface 11. Within the lower portion of frame 56, an oscillator subassembly 59 is mounted. Included in subassembly 59 is a horizontal movable surface 60, preferably of resilient or flexible material within which are defined an array of depressions 62 in the form of cups. The array of cups of course matches apertures 23 of support assembly 10 in number and spacing, as well as being somewhat larger in diameter than the sample tubes, so that the depressions may engage the bottoms of the sample tubes 14 as they are arrayed within support assembly 10 when it is mounted upon frame 56. Beneath surface 60 within subassembly 59 is a power driven oscillator which is coupled to surface 60 and imparts an oscillatory motion, preferably with a rotational component, so that the motion is orbital, to all of depressions 62, and in the horizontal plane.

Frame 56 further incorporates upwardly extending members 66 at the corners thereof, which provides support for assembly 10 and to which assembly 10 is firmly secured during mixing or vortexing so that the tray 22 is held stationary. Members 66 are of a length sufficient to maintain tray 22 above surface 60, at a height less than that of tubes 14 which is optimal for the action of the apparatus. If tubes 14 are not already longitudinally positioned with respect to the tray 22 so that they match this optimal height, they are merely pushed downwardly until engaged within the cups.

During the operation of apparatus 16, the sample tubes 14, engaged by the cups, will undergo orbital motion as indicated in phantom and with the directional arrows in the broken-away portion of FIG. 2. The longitudinal position is maintained, since no significant upward force is exerted by movable surface 60, and the rotational displacement of the tube bottoms is smoothly accommodated at the tray level as the retainers rotationally pivot within the apertures 23. The action is a smooth low-friction and non-binding one, due to the previously described displacement control means defined thereon. This motion sets up a swirl current within tubes 14 which effectively combines the components within the tubes. Alternatively, if the cups 62 are oscillated linearly rather than orbitally, the sample tube contents will merely be mixed without a swirl current. Note also that it is not necessary to be restricted to cup-like depressions; for example, circular holes in movable surface 60 would also serve.

The above described apparatus 16 is not the only possibility which would be effective with the present support assembly to obtain mixing. For example, an even simpler apparatus could be provided in which support assembly 10 with sample tubes 14 containing components to be mixed or vortexed would be edge supported, with the sample tubes allowed to hang freely. The tray would then be securely fastened, and oscillatory or orbital forces would then be applied to the tray by means of the members supporting the tray. The tubes at their lower sample containing ends would either swing back and forth or rotate with a greatly increased amplitude as compared to that of the driving force. Again the action would be smooth and non-binding, due to the previously described displacement control means. Also, separate cup assemblies moving vertically beneath the tubes as they are held within assembly 10 on a frame such as 56 may be employed to selectively access various of the tubes from below and oscillate these only, while the remainder hang undisturbed within assembly 10.

Equally important to the overall concept of simultaneous processing of a multiplicity of samples while maintaining them in the same support assembly is the apparatus of FIG. 4. This apparatus completes the machine processing to measure the radioactivity of each sample, and the unique relationships and manner of operation illustrated are again made possible because of support assembly 10. The figure shows in partial schematic form a complete gamma counter 18 which is especially appropriate for counting low energy isotopes such as $^{I}$-126 and $Co_{57}$. The counter is designed for counting a plurality of discrete samples simultaneously, basically as disclosed in the above-mentioned co-pending application Ser. No. 366,676.

Counter 18 is unusual in that it includes movable detector head 20 of shielding material, such as lead, in which are defined three elongated, upwardly opening cavities 71, 72 and 73, side by side, with the side cavities 71 and 73 being angled with respect to the center cavity 72. Within the cavities are bottom-most photomultiplier tubes 75, uppermost crystals 76 defining a cup-like cylindrical upwardly opening counting chambers 77, 78 and 79, and intermediate interfaces 80 coupling respective photomultiplier tubes and crystals. The fully assembled head 20 thus comprises a movable sensing device providing a plurality of separate signals from the photomultipliers to simultaneously represent the activities of three samples.

The counter circuits then process the respective signals individually through the usual steps, with the phototube output lines 81, 82 and 83 going to amplifier means 84, which then feeds pulse height discriminator means 86 which in turn supplies the inputs for data storage and processor means 87 for handling and correlating the signals and calculating results. Counter 18 is also equipped with an appropriate detector head drive means 89 cooperating with a detector head control means 90 for transporting detector head 20 beneath one or more units of sample support assembly 10 edge-supported in stationary position upon the counter. Detector head 20 is thereby moved up and down into and out of engagement with the sample tubes 14A, 14B and 14C of a row as shown, and thereafter laterally, to subsequent rows and support assemblies to repeat the counting cycle in a programmed manner. For a more detailed description of the detector head control and drive means, as well as the signal processing and control circuits, see the above-mentioned application Ser. No. 366,676.

Returning now to a more detailed consideration of detector head 20 and its relationship with support assembly 10, the upwardly opening cavities 71–73 terminate in narrowed mouths or inlets 92 which flare outwardly from the upper ends of the counting chambers 77–79. Thus, inlets 92 comprise the inlets to counting chambers 77–79. The flanking counting chambers 77 and 79 are equally spaced and inclined with respect to the central vertical counting chamber 78 at an angle of 10°. Optionally, the angle may be at some other angle which is less than the angular displacement limit for retainers 24 with their associated sample tubes. The diameter of each counting chamber 77–79 is larger than that of sample tubes 14, permitting the tubes to pass in and out of the chambers without binding, and the chamber depth is fixed at a distance sufficient to admit a substantial fraction of a sample tube within each chamber.

The details of the spacing between counting chambers 77–79, as well as their spatial relationship with the support assembly, are very important. The spacing between adjacent ones of apertures 23 of the rows of support assembly 10, and that between inlets 92, is related so that the bottoms of the tubes of a row depending from support assembly 10 are engaged by inlets 92 when head 20 is brought up to support assembly 10 from below, in lateral alignment with the row, and with central chamber 78 vertically aligned with the center sample tube 14B. This facilitates the spreading apart and angular displacement of the flanking samples 14A and 14C, and the engagement and guiding of the tubes into the chambers as the head is moved upwardly into counting position (which is the position illustrated in FIG. 4).

In order to accomplish this, head 20 must be designed properly so that the spacing between the closest point on adjacent inlets 92 is less than the distance between centers of support assembly apertures 23. It will be noted that the distance between centers of adjacent ones of chambers 77–79 at the inlets 92 is somewhat greater than that between adjacent apertures in a row (or the distance between adjacent columns). At the bottoms of chambers 77–79, or at the deepest tube positions therewithin, the distance between the chamber centers is less than the maximum spacing between the bottom portions of three tubes 14A–14C of a row. This is because of the angle between counting chambers being fixed at less than the maximum angular displacement limit of the sample tubes, and guarantees that the sample tubes will not bind inside the counting chambers during the measurement of sample activities. Also this relationship between the chambers and the sample tube displacement angles insures that any tolerance errors in the head displacement drive will be taken up without any untoward effect, since the tubes still will be able to spread apart even more, if the drive brings the head up somewhat beyond the normal predetermined counting position.

In this manner, sample radioactivity apparatus is provided which not only processes samples three at a time, resulting in itself in vastly increased throughput, but which also is considerably more reliable and less complex, with no individual sample ever being removed from the sample support, and which is compatible with all the previously discussed RIA protocol steps and processing apparatus. Indeed, the same advantages obtained throughout the above described system, with the samples remaining in the same sample support assembly and in the same order throughout the entire protocol, so that the identification means of the support assembly desirably also controls the machine processes. Because of the support assembly used with the radioactivity sensing apparatus, and the compatibility therebetween, a much higher packing density of samples may be obtained in a counter of given size. Thus even the initial burden of loading the counter or other processing apparatus is minimized. Finally, with the system and apparatus above disclosed, samples are generally never individually handled, and an overall speed and reliability is inherently obtained which is significantly higher than has heretofore been possible.

We claim:

1. A support assembly for holding sample tubes, said assembly comprising: a tray including at least one aperture; at least one apertured and generally annular retaining device for disposition about a sample tube and in which a sample tube is insertable to be resiliently gripped and thereby retained therein, said retaining device being disposed in the tray aperture such that the retaining device and a sample tube inserted therein is freely suspended downwardly from the tray in a self-aligning substantially vertical orientation though in a manner allowing free-swinging orbital and angular movement within predetermined limits; said retaining device including a section which extends through and is dimensioned to loosely fit within the tray aperture, which section has an upper portion which overlaps the upper surface of the tray to effect retention and accommodation of the retaining device in the tray aperture and prevents same from falling through said aperture; said retaining device further including a resilient section which protrudes from the aperture below the tray, said protruding section including an enlarged shoulder portion of a diameter greater than that of the tray aperture, which shoulder portion is spaced from a lower surface of the tray and which shoulder portion defines means limiting the extent of movement of said retaining device in said aperture; said protruding section of said retaining device further including circumferentially spaced gripping portions which downwardly extend and which resiliently engage an inserted tube to adjustably retain the tube such that a vertical sliding displacement of an inserted tube relative to the retaining device and the tray can be effected upon the application of a predetermined force to the tube.

2. An assembly as defined in claim 1, in which said section which extends into the tray aperture is in the shape of a truncated cone which enlarges upwardly, said aperture having a generally cylindrical inner wall surface.

3. An assembly as defined in claim 2, in which said upper portion of said upwardly enlarging section includes an outwardly extending flange, said flange overlapping the upper surface of the tray.

4. An assembly as defined in claim 2, wherein said aperture in said retaining device has an internal passageway of round cross-section and a diameter which, in the region of said section which extends into the tray aperture, is larger than said sample tube, and wherein said gripping portions include lips which extend radially inward and which are transversely spaced so as to contact and provide said resilient engagement with the sample tube upon insertion thereof.

5. As assembly as defined in claim 4, wherein said lips are respectively positioned on the extremity of each gripping portion.

6. An assembly as defined in claim 1, wherein said gripping portions are lowermost on said retaining device.

7. An assembly as defined in claim 1, in which said gripping portions are radially compressible.

8. A tray assembly as defined in claim 7, in which said radially compressible gripping portions and said enlarged shoulder portions are forced into a radially compressed condition at the interface of contact with the tray aperture during insertion, whereby installation and subsequent removal is facilitated.

* * * * *